United States Patent [19]

Schultz et al.

[11] 4,418,951

[45] Dec. 6, 1983

[54] ROTARY LATCH FOR SCREEN DOOR

[75] Inventors: Steven C. Schultz; Thomas A. Vaughn, both of Rice Lake, Wis.

[73] Assignee: Nichols-Homeshield, Inc., Aurora, Ill.

[21] Appl. No.: 283,951

[22] Filed: Jul. 16, 1981

[51] Int. Cl.[3] ..... E05C 3/04

[52] U.S. Cl. ..... 292/202; 292/206

[58] Field of Search ..... 292/202, 241, 244, 257, 292/206, DIG. 7, DIG. 38, DIG. 46

[56] References Cited

U.S. PATENT DOCUMENTS

| | | | |
|---|---|---|---|
| 297,187 | 4/1884 | Smith | 292/DIG. 7 |
| 495,645 | 4/1893 | Willer | 292/202 |
| 1,398,174 | 11/1921 | Carlson | 292/DIG. 7 |
| 1,608,588 | 11/1926 | Dundek et al. | 292/DIG. 30 |
| 1,767,450 | 6/1930 | Harrington | 292/DIG. 7 |
| 3,479,076 | 11/1969 | Schallehn | 292/257 X |

*Primary Examiner*—Richard E. Moore

*Attorney, Agent, or Firm*—McWilliams, Mann, Zummer and Sweeney

[57] ABSTRACT

This invention relates to a rotary type latch for sliding screen doors wherein the rotary member is molded from a plastic material such as a polycarbonate and which is rotatable in either direction for universal application to either right hand or left hand door operations. The rotary latch engages a slot in a door pull molded from a similar plastic material and contacts the screen door frame through the slot to cam the door against a retaining channel mounted on a door frame. The rotary latch includes a plurality of flat cam faces affording multiple locking positions and which necessitate positive lock rotation to enable the latch to be disengaged. This latch mechanism is of particular usefulness for application to sliding patio screen doors where the screen door closes into a pocket within the side jamb of the patio door frame.

6 Claims, 8 Drawing Figures

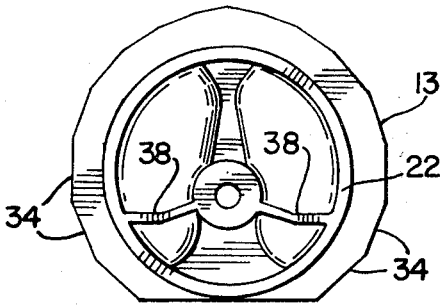
FIG. 7
FIG. 8
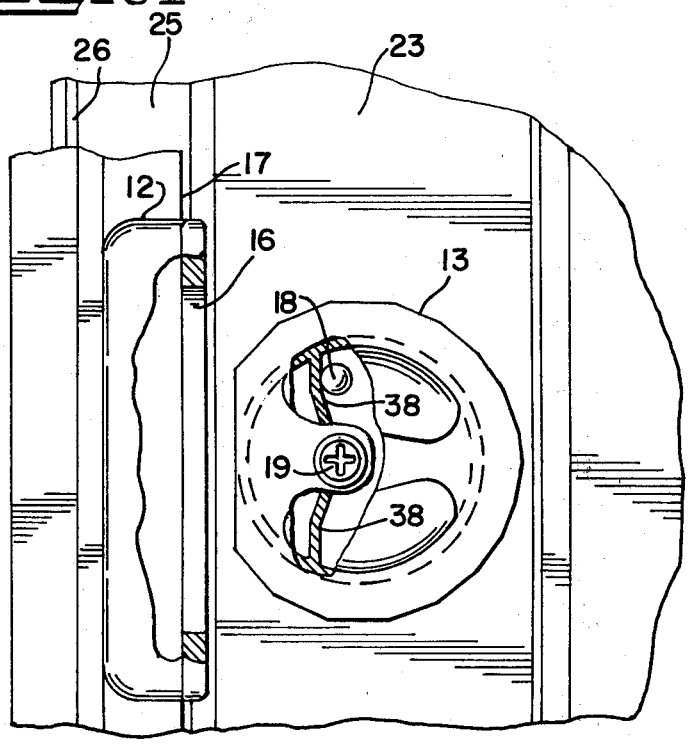

ROTARY LATCH FOR SCREEN DOOR

BACKGROUND OF THE INVENTION

1. Field Of The Invention

The invention pertains to door locks, or latches primarily for light weight doors and especially for screen doors of the sliding type that slide toward a jamb, or into a pocket in a side jamb.

2. Description Of The Prior Art

Heretofore, the available devices have been quite simple in their adaptation to this general type of lock application and have included a basic hook type of fastening which was manually engageable with a cooperating eye member.

Relatively sliding window members have been secured by means of a fixed lug on one member and a rotatable wedging member on the other window member which were adapted to be interengaged in the closed position of the windows to fix them against relative movement.

Similar devices have been provided to lock the companion doors of a pair of sliding doors where such doors operate in parallel planes.

Sliding door locks have included pivoted latches to engage a cooperating slot, or an associated bracket.

Rotary latches have been provided in combination with door handles as an assembly including a latch hook.

Other latch hook arrangements have included pivoted latch members projecting through the edge of a door to engage a slot, or bracket, in an opposing part to lock a door, with an operating handle accessible from a side face of the door to release the latch from the slot.

Another type of sliding door latching arrangement for doors operating in trackways included a vertically movable latch plate in one door edge adapted to engage and interlock with a fixed keeper on an adjoining door, or on a framing member and having an outside handle to lift the latch plate.

The following patents disclose latching, or locking mechanisms like those described, U.S. Pat. Nos. 3,645,573; 3,785,684; 4,160,560; 4,068,874; 3,065,985; 3,213,652. None of these prior patents, however, suggest any such latching arrangement as the present latch mechanism which has for its primary objective to provide a rotary latch element of molded plastic adapted to be mounted universally for right, or left, installations and disposed to cam a door against a mounting member, and provided with multiple flats on the rotary member to provide a plurality of locking positions.

SUMMARY OF THE INVENTION

The latching mechanism of this invention provides a rotary latching member molded from a plastic material such as a polycarbonate and a companion door pull member also molded from a similar plastic material.

The latching member is mounted by means of a single screw, or the like, to provide a pivot point about which the latch member rotates and which is universally adaptable to either right hand or left hand operation.

A plug member inserted into an opening in the face of the jamb acts to limit the degree of movement of the latching member.

The latch member functions as a camming device and engages through a slot in the door pull to contact directly with the door frame to cam the door outwardly against a retaining member such as a channel member on a door jamb.

The rotary camming member has a plurality of flat faces on its camming surface whereby the door could be cammed outwardly by steps and provide a number of locking positions which enable the door to be "clicked" into final position.

When the rotary cam device is engaged through the slot in the door pull, it is positively locked against relative movement and the several locking positions necessitate manual rotation of the cam to release the door while, by the same token, the door cannot be jarred, or pushed inward from the outside to rotate the cam and cause it to disengage from any of the positive locked positions.

DESCRIPTION OF THE DRAWINGS

The rotary latching mechanism having the features described is illustrated in the accompanying drawings, wherein

FIG. 7 is a rear elevational view of the cam latch member; and

FIG. 8 is a front face view of the cam latch member mounted on the door jamb and lockingly engaged with a door and having portions of the latch member broken away to reveal the plug member mounted in the jamb to limit rotation of the cam.

DESCRIPTION OF PREFERRED EMBODIMENT

Figure 2:
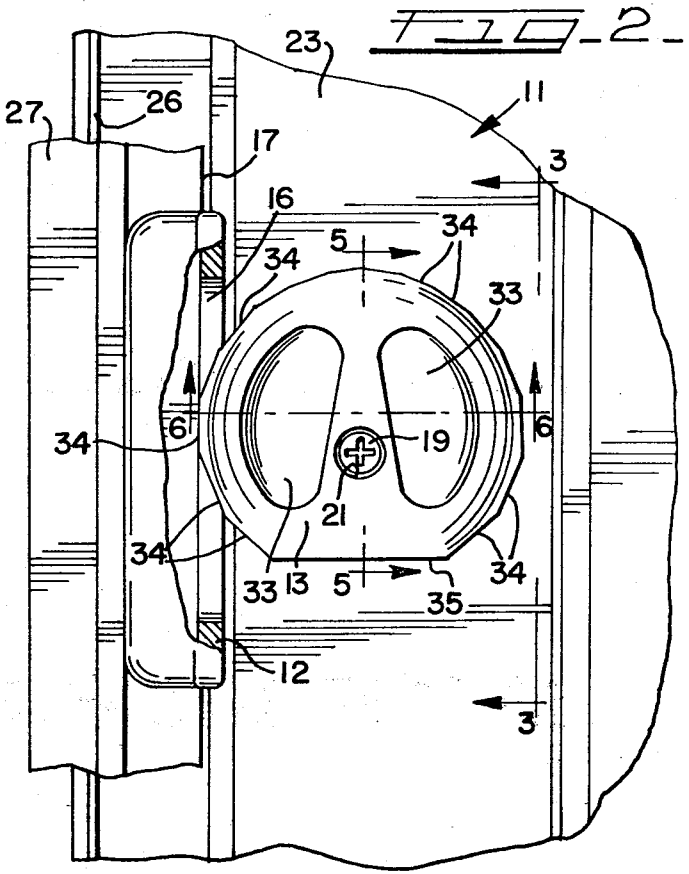
FIG. 2 is an elevational view of the rotary camming latch member as applied on the jamb member of a door frame, with the door pull member shown applied on a sliding door which is movable toward and away from the jamb, with the camming member disposed in engagement with the door within the slot in the pull member.
Figure 1:
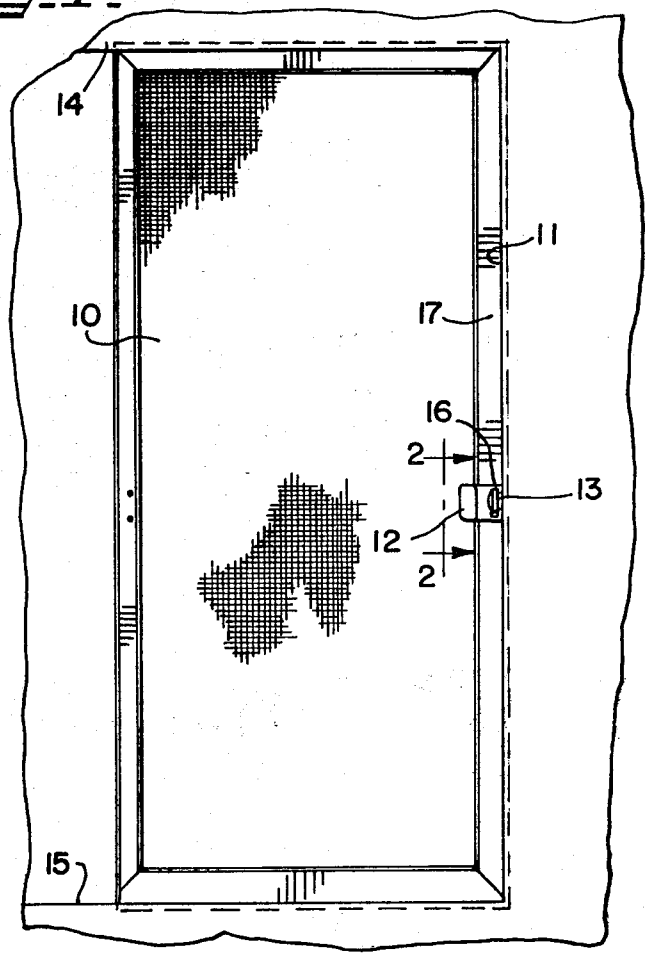
FIG. 1 is a general elevational view of a sliding door disposed in sliding relationship to a jamb and equipped with the rotary cam latch of this invention on the jamb and with a pull member on the door.

In the drawings a door 10 and a jamb 11 is shown in FIG. 1 with the door 10 equipped with a door pull 12 and the door jamb 11 having a rotary cam type latching element 13 pivotally mounted on the face of the jamb adjacent to the door 10. The door operates in upper and lower tracks 14 and 15 which are disposed in side-by-side relationship so that the door is disposed in overlapping relationship to the jamb when in the fully closed position. The door may be glass panelled, or as shown here, may comprise a screen door, which while fairly light weight, is of rigid construction. The door pull 12 is provided with a vertically disposed slot 16 and in the closed position of the door the cam latching member 13 engages in this slot, as best shown in FIGS. 2 and 8 and contacts the face of the door frame 17 to press the door outwardly under the influence of the camming action of the latch 13.

Figure 3:
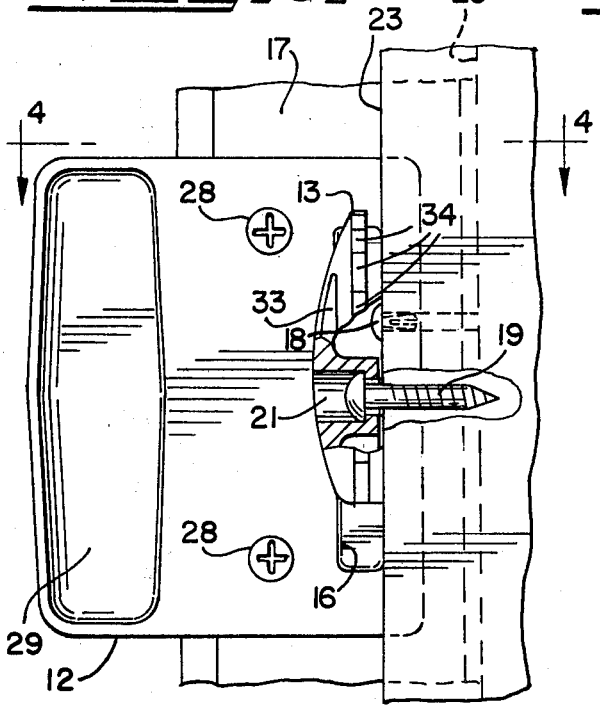
FIG. 3 is a detail view to the same scale as FIG. 2, showing the camming latch member applied on the jamb by means of a single pivot screw about which the cam rotates and with the door pull member engaged within its slot by the cam member.

As best shown in FIGS. 1 and 8, the cam latch member 13 is pivotally mounted in the face 23 of the jamb 11 so that it is disposed in an operating plane at right angles to the slot 16 in the door pull. The pivotal mounting of the cam is obtained by means of a single screw 19 as best indicated in FIG. 3 enabling a controlled light frictional contact of the cam against the face 23 of the jamb 11. The cam 13 is provided with a recess 21 into which the head of the screw 19 is received so that the head of the screw does not project beyond the frontal surface of the cam member but is disposed within the recess at a depth sufficient to prevent contact by anyone manipulating the cam.

On the side of the cam disposed toward the door jamb on which it is mounted, the cam is provided with a projecting flange 22 that is completely circular but is not centered on the pivot point of the mounting screw 19 so that it moves eccentrically when the cam 13 is rotated, as does the entire cam, inasmuch as the cam is eccentrically mounted so as to move toward a fully locked position in the slot 16, when actuated, or toward a fully released position when the cam is moved by hand out of the slot. The circular flange 22 is adapted to act somewhat as a guiding surface for the cam 13 by contact with the jamb face 23 during rotation of the cam and this contact also braces the cam against the possibility of the cam cocking under forces encountered when the cam is engaged in the door pull slot 16. Thus, the cam 13 is braced in movements of the door 10 in either direction.

Rotation of the cam latch member 13 is limited by means of a stop member 18 in the form of a plug inserted into an opening in the jamb 11 and secured by a snap fit. This stop member is disposed in position to be engaged by one or the other of a pair of oppositely disposed web plates 38 formed integrally with the flange 22 surrounding the plates 38 at the back side of the cam latch 13. The plates 38 extend toward the center of the cam from the rim 22 at opposite sides of the cam. This is best shown in FIG. 8 where it will be seen that rotary movement of the cam in an opening direction to release the door 10 and pull member 12, will bring the related web plate 38 into engagement with the stop 18 whereby opening movement of the cam is limited. The web plates 38 at opposite sides of the center of the cam latch member 13 enables the cam latch to be utilized in either a right or left hand mode and obtain the benefit of the limit stop arrangement in either mode.

Figure 4:
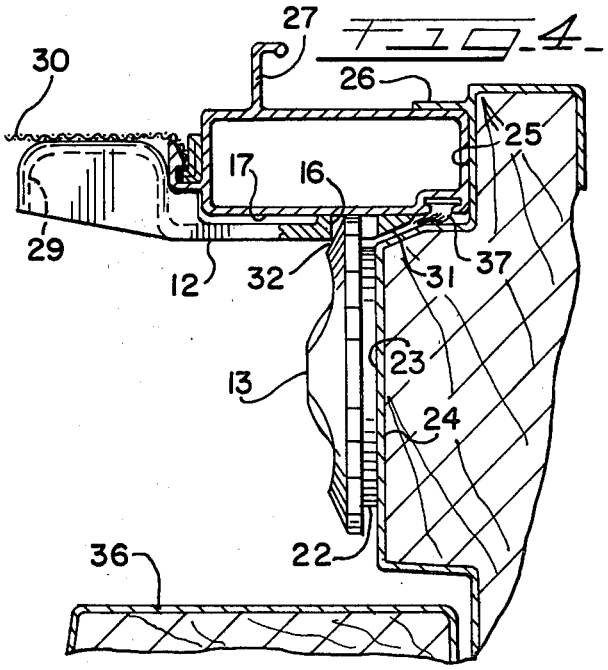
FIG. 4 is a horizontal sectional view taken on the line 4—4 of FIG. 3 showing the relationship of the sliding door with the jamb and the door pull and camming latch operatively engaged and also illustrating an inside main door with the cam between the two doors.
Figure 6:
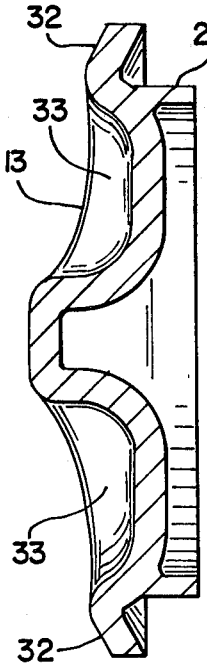

The door pull 12 and cam 13 are shown generally in FIG. 1 as applied to a door and jamb 10 and 11, but FIGS. 2, 3 and 4 show the detail door locking arrangement as applied in relation to this single door type of installation as adapted to be locked against the jamb structure 24. The functioning of the cam and its relation to the door pull slot is fully revealed in this application. As best shown in FIGS. 3 and 4, the cam 13 is pivotally mounted directly on the face 23 of the door jamb which, as shown, comprises a wood core encased in a PVC enclosure 24, shaped to include a channel shaped recess 25 into which the leading edge of the door, represented by the frame portion 17, enters when the door is closed. The channel 25 has an outside flange 26, see especially FIG. 4, against which the door frame 17 is pressed by the camming action of the latch 13. The door frame 17 includes an outside handhold 27 by means of which the door may be actuated to any position between full open and fully closed when the cam latch is in its released position.

The door pull 12 is mounted on the door frame member 17 at the inner side thereof, by means of screws 28 and is provided with a handhold 29 for operation of the door from the inside between open and closed positions. The door is illustrated as including a screen panel 30, but this could comprise a glass panel if that type of door is required to be used. The slot 16 in the door pull for the cam 13, is located adjacent to the front edge of the pull member 12 and the leading edge of the door pull is tapered, as at 31 to provide a lead-in for the screen door entering the pocket on the jamb.

The cam latch member 13 may be manipulated manually to rotate the eccentrically mounted cam either to its locked position, or to its released position by means of finger hold recesses 33, which are best shown in FIG. 2 and since the pivot point 21 of the cam is off center, also as clearly illustrated in this Figure, the cam when tilted toward the locking position in slot 16 can then be moved toward the fully locked condition on its eccentric mounting. Conversely, if the cam 13 is moved manually out of the slot 16 and tilted about the pivot point 21 toward the released position, its eccentric mount will enable it to be moved toward the fully released position.

The mounting screw 19 provides a degree of tension on the cam 13 in that it develops a light friction of the cam lock against the face 23 of the door jamb 11 and limited movement of the cam is restricted by the stop 18 so that the cam will hold in any position and will not rotate freely but must be rotated manually.

FIG. 2 also best illustrates an important progressive locking feature of the cam 13, where it can be seen that the outer, or peripheral surface of the cam is provided with a plurality of flat surfaces 34, which are formed in continuous succession around the major portion of the outer cam surface. These surfaces are adapted to engage the surface of the door frame 17 through the slot 16 in a step-by-step movement until the cam reaches its final locked position pressing the door frame 17 against the flange 26 on the door jamb channel 25. This might be described as a clicked into place actuation as the cam 13 moved, or is actuated manually, about the pivot 19.

Figure 5:
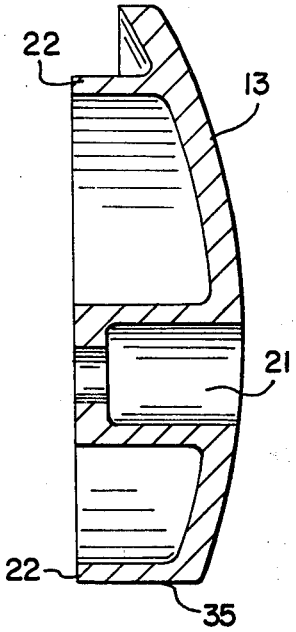
FIGS. 5 and 6 are detail sectional views to larger scale taken respectively on the lines 5—5 and 6—6 of FIG. 2 showing the structure of the cam latch member.

The cam 13 also includes an extended flat surface 35 and it should be noted that the flange 22 does not extend beyond this flat surface but, as shown in FIG. 5, is actually flush with the flat 35 at the maximum point of the flange. When the cam is rotated to dispose the flat 35 in a vertical position parallel to the door and the door pull 12, the flat will clear the door and the door pull so that the door can be slid past the cam 13 without actuating the cam in either direction of movement of the door and without restricting movement of the door.

Both the cam 13 and the door pull 12 are made from a plastic material such as a molded polycarbonate and one material of this type suitable for these parts comprises General Electric's Lexan #143 or, a molded rigid PVC might be used, such as #85856 by B. F. Goodrich.

The cam, of course, is disposed at the inner side of the outer door, as best indicated in FIG. 4, so that when an inner door is also involved, the cam 13 will be disposed on the face 23 of the door jamb element 24 between the inner and outer doors. An inner door 36 is indicated in this Figure and in some installations this may comprise a swinging door or, in other applications it may also be a sliding door.

It should be noted that when any of the flat faces of the cam represented by the several surfaces 34 is in engagement with the surface of the door frame member 17, the face-to-face contact makes it necessary that a positive rotation of the cam member 13 must be resorted to in order for the latch to be disengaged from the door and the slot 16. This face-to-face contact also prevents the cam 13 from being jarred out of its locking position, as by pushing on the door from the outer side.

A seal member 37 may be incorporated on the door frame member 17 where it engages with the jamb element 24 to exclude bugs, or the like, when the installation comparises a screen door, or also to prevent drafts when the door is glass panelled as either a storm door, or a prime door.

From the foregoing, it will be seen that an effective door latching arrangement has been provided wherein nonmetallic operating parts have been utilized to facilitate manufacture and reduce the cost and utilizing a rotary operating camming device to latch the door and which is engaged directly with the door through a locking slot in a door pull member installed on the door and wherein the latching cam operates at right angles to the direction of movement of the door and door pull member and which may be installed for either right hand or left hand operation. The cam member is mounted on a part such as a door jamb, to provide a locked relationship between the door pull and cam to prevent relative sliding movement.

What is claimed is:

1. A door latching arrangement including a door pull member mounted on a sliding door and a rotary cam member disposed at a right angle to the door pull member and mounted on a part to provide a locked relationship against relative sliding movement of the members, said door pull member having an open locking slot, said rotary cam member entering through said locking slot to engage said sliding door, said cam member being eccentrically mounted to move toward a locked position and when released to move toward unlocked position, and said cam member being provided with a plurality of flat faces about its periphery adapted to engage said door in a step-by-step movement.

2. A door latching arrangement as set forth in claim 1 wherein said cam member includes a single pivot and having a continuous flange projecting toward said part to brace the cam at opposite sides of the pivot.

3. A door latching arrangement as set forth in claim 2 wherein a web plate extending inwardly from said flange engages a stop member on said part to limit movement of the cam.

4. A door latching arrangement as set forth in claim 1 wherein said cam member is provided with an extended flat surface on its periphery effective in the unlocked position of the cam member to enable movement of the door and door pull member past the cam member without interference.

5. A door latching arrangement as set forth in claim 4 wherein said single pivot is recessed below the face of the cam member.

6. A door latching arrangement as set forth in claim 2 wherein said pivot comprises a screw member, said screw member being adapted to create a frictional engagement of the cam against said part to resist movement of the cam.

* * * * *